US007611037B1

(12) United States Patent
Bazzano

(10) Patent No.: US 7,611,037 B1
(45) Date of Patent: Nov. 3, 2009

(54) NAIL GUN HANGER

(75) Inventor: Michael A. Bazzano, Kaysville, UT (US)

(73) Assignee: BLMS Enterprises LLC, Lebanon, TN (US)

( * ) Notice: Subject to any disclaimer, the term of this patent is extended or adjusted under 35 U.S.C. 154(b) by 0 days.

(21) Appl. No.: 12/121,107

(22) Filed: May 15, 2008

(51) Int. Cl.
*B25C 7/00* (2006.01)

(52) U.S. Cl. ..... 227/154; 227/156; 81/435; 248/217.1; 248/228.4

(58) Field of Classification Search ..... 248/217.1, 248/227.2, 228.4, 231.51, 218.4; 227/156, 227/154; 81/435, 57.4
See application file for complete search history.

(56) References Cited

U.S. PATENT DOCUMENTS

| | | | | | |
|---|---|---|---|---|---|
| 140,234 | A | * | 6/1873 | Ames et al | 248/227.2 |
| 644,985 | A | * | 3/1900 | Lawton | 248/217.1 |
| 1,098,945 | A | * | 6/1914 | Frederick | 182/187 |
| 1,955,476 | A | * | 4/1934 | Torgersen | 248/208 |
| 3,016,225 | A | * | 1/1962 | Hughes et al. | 248/229.11 |
| 3,353,778 | A | * | 11/1967 | Sylvain et al. | 248/211 |
| 4,139,173 | A | * | 2/1979 | Kahn | 248/311.2 |
| 5,490,649 | A | * | 2/1996 | Kusalich | 248/214 |
| D373,243 | S | | 9/1996 | Tovey et al. | |
| 5,636,819 | A | * | 6/1997 | Kettlestrings | 248/216.1 |
| 5,673,830 | A | | 10/1997 | Matthews | |
| D559,081 | S | | 1/2008 | Myers | |
| 2007/0063120 | A1 | | 3/2007 | Robbins | |
| 2007/0295885 | A1 | | 12/2007 | Vidal | |

* cited by examiner

*Primary Examiner*—Korie Chan
(74) *Attorney, Agent, or Firm*—Sturm & Fix LLP

(57) ABSTRACT

The present invention provides a nail gun hanger including a C-shaped bracket and a pivotally attached lever. An inner arm of the lever carries a tooth that engages the bottom surface of a framing member such as a rafter or joist, when the outer arm of the lever supports the weight of a nail gun. The nail gun hanger allows the operator to hang the gun on a framing member to enable the use of both hands for other tasks. When the gun is lifted and its weight is no longer supported by the outer lever arm, the tooth of the inner lever arm disengages from the bottom surface of the rafter so the gun can be removed from the rafter and used.

10 Claims, 5 Drawing Sheets

NAIL GUN HANGER

BACKGROUND OF THE INVENTION

1. Field of the Invention

The present invention relates to the field of work tool accessories, and more particularly to a hanger for a nail gun.

2. Description of Related Art

As can be seen by reference to the following U.S. Pat. Nos. D373,243; D559,081; 5,673,830; and U.S. Publn. Nos. 20070063120 and 20070295885, the prior at is replete with myriad and diverse accessories for supporting work tools while not in use.

While all of the aforementioned prior art constructions are adequate for the basic purpose and function for which they have been specifically designed, they are uniformly deficient with respect to their failure to provide a simple, efficient, and practical hanger for a nail gun.

As a consequence of the foregoing situation, there has existed a longstanding need for a new and improved nail gun hanger, and the provision of such a construction is a stated objective of the present invention.

BRIEF SUMMARY OF THE INVENTION

Briefly stated, the present invention provides a nail gun hanger including a C-shaped bracket and a pivotally attached lever. An inner arm of the lever carries a tooth that engages the bottom surface of a framing member such as a rafter or joist, when the outer arm of the lever supports the weight of a nail gun. The nail gun hanger allows the operator to hang the gun on a framing member to enable the use of both hands for other tasks. When the gun is lifted and its weight is no longer supported by the outer lever arm, the tooth of the inner lever arm disengages from the bottom surface of the rafter so the gun can be removed from the rafter and used.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
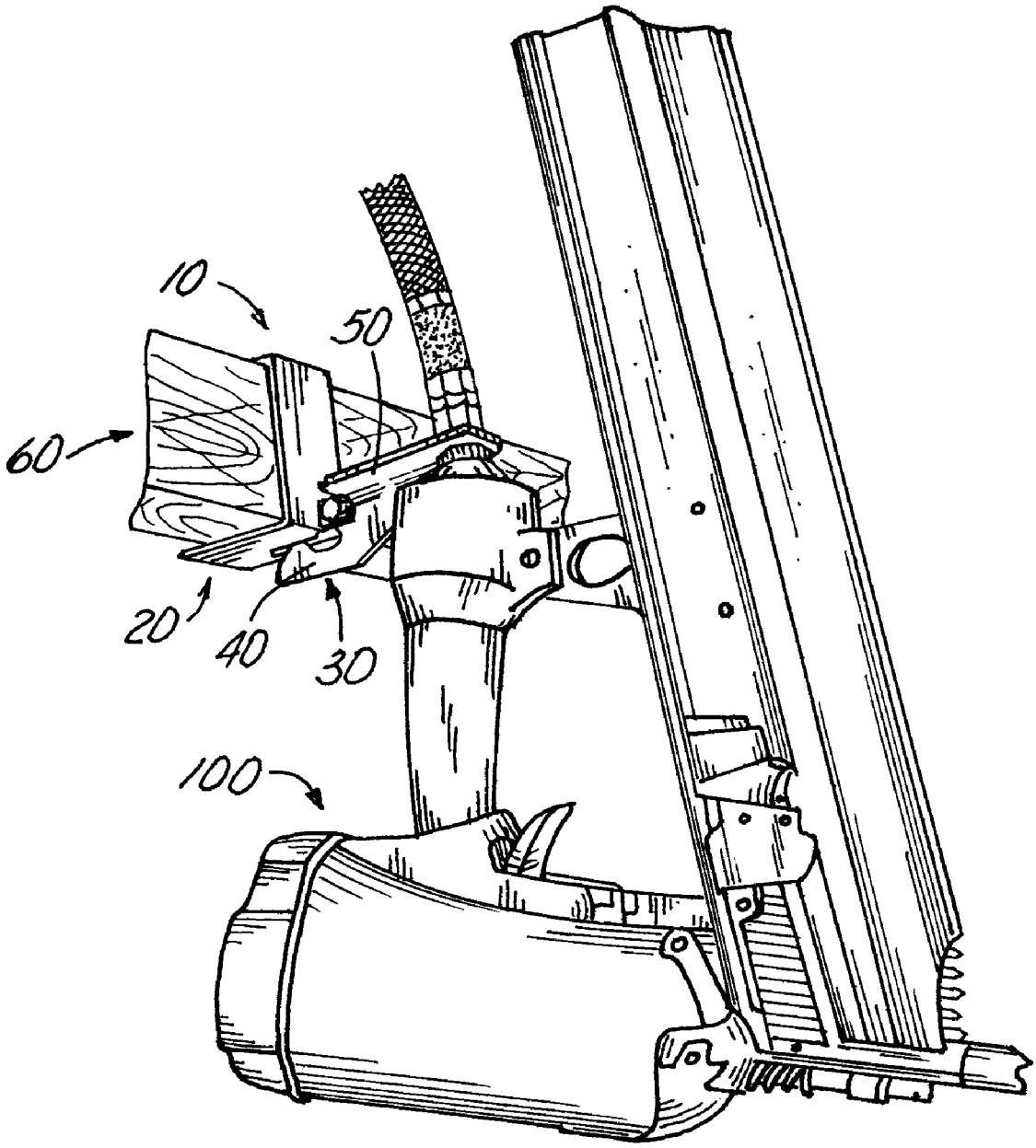
FIG. 1 is a perspective view of the nail gun hanger of the present invention supporting a nail gun on a rafter.
Figure 2:
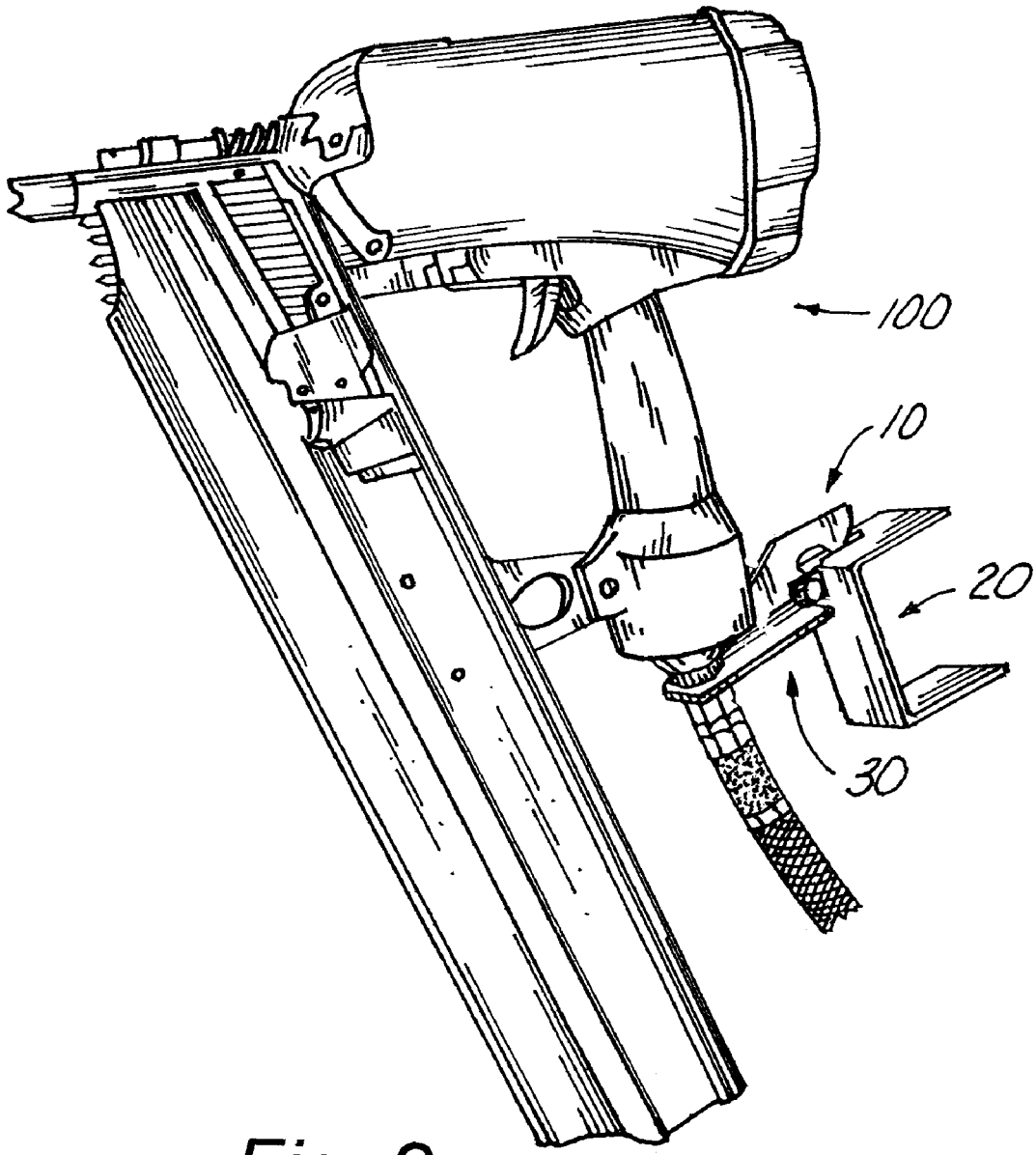
FIG. 2 is a perspective view showing the nail gun hanger attached to the nail gun when the gun is in an operating position.
Figure 3:
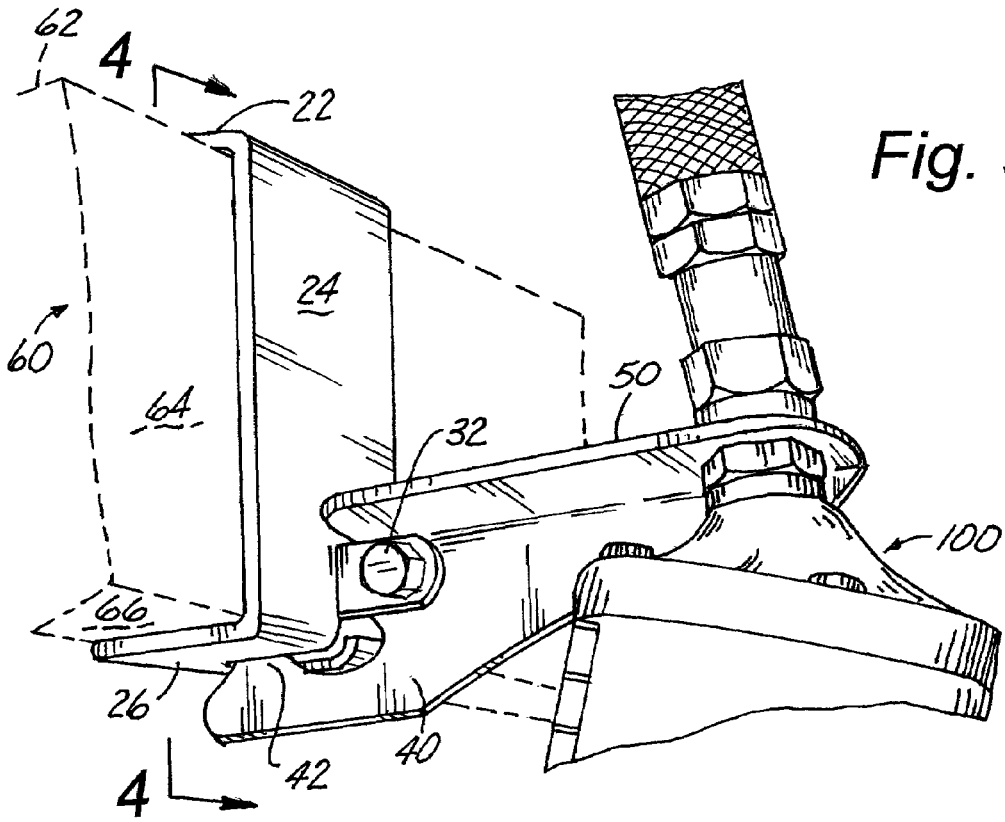
FIG. 3 is an enlarged partial perspective view of the nail gun hanger supporting a nail gun.

As can be seen by reference to the drawings, and in particular to FIG. 1, the nail gun hanger that forms the basis of the present invention is designated generally by the reference number 10.

As best shown in FIGS. 3-7, the nail gun hanger 10 includes a C-shaped bracket 20 having a top 22, a side 24, and a bottom 26. The bottom 26 includes a slotted opening 28. A lever 30 is attached to the bracket 20 at a pivot point 32. An inner arm 40 of the lever 30 carries a tooth 42, and an outer arm 50 of the lever 30 carries an opening 52 for attachment of a nail gun 100.

Figure 4:
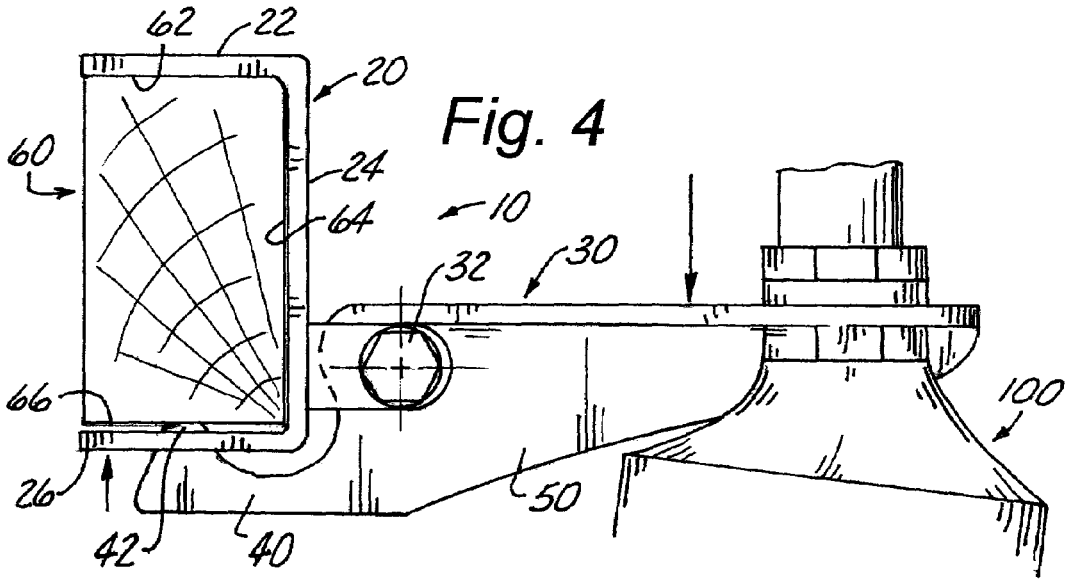
FIG. 4 is a sectional view taken along line 4-4 of FIG. 3 showing the tooth on the pivoting lever engaging the bottom edge of the rafter to secure the hanger in position.

Referring now to FIG. 4, it can be seen that the top 22, side 24, and bottom 26 of bracket 20, engage a corresponding top 62, side 64, and bottom surface 66 of a framing member 60, such as a rafter or joist. Also, when the weight of the nail gun 100 is carried by the outer arm 50 of the lever 30, the tooth 42 of the inner arm 40 extends through the slotted opening 28 and frictionally engages the bottom surface 66 of the framing member 60, thus securely attaching the gun 100 to the framing member 60.

Figure 5:
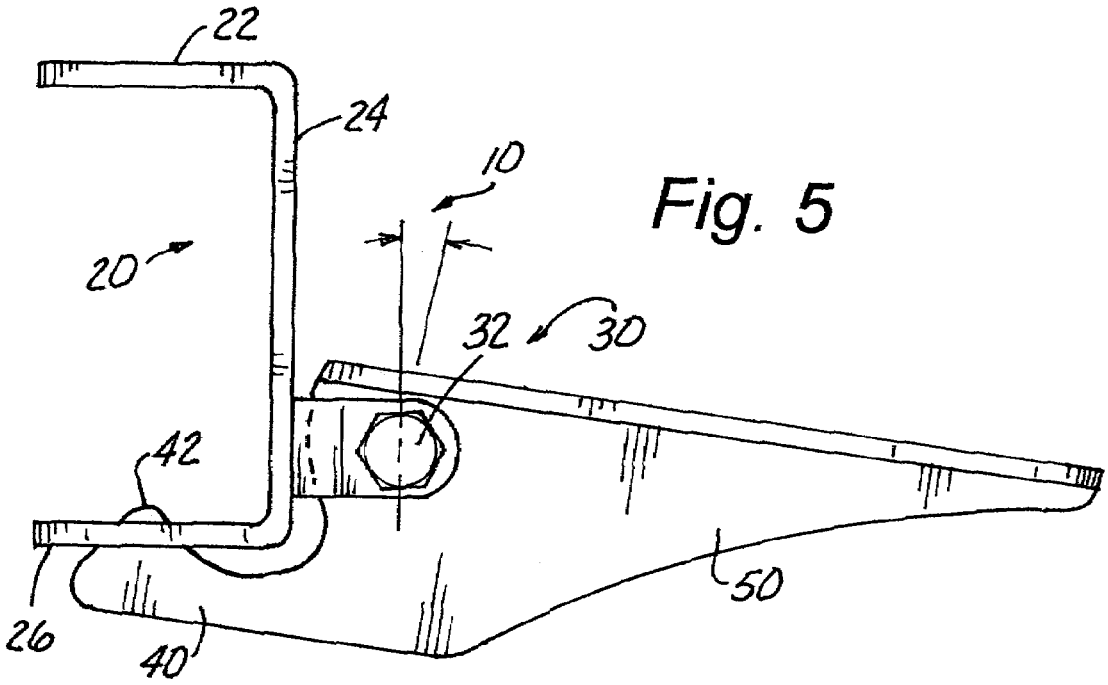
FIG. 5 is a side elevational view of the hanger in the rafter engaging position.
Figure 6:
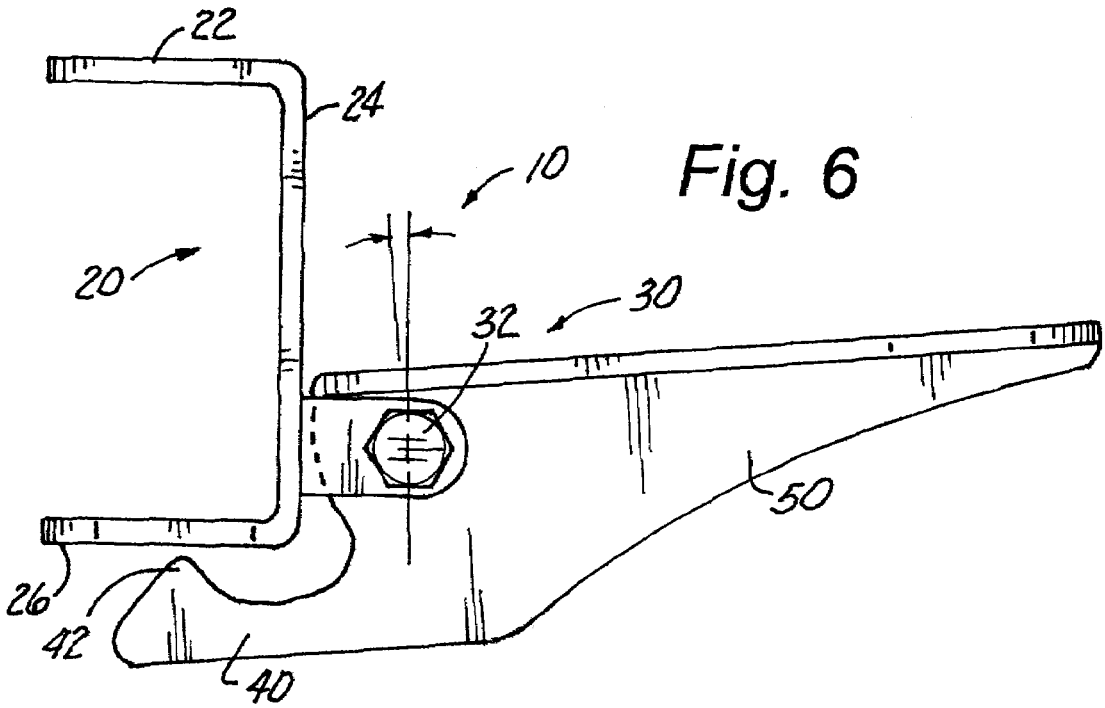
FIG. 6 is a side elevational view of the hanger in the free working position.
Figure 7:
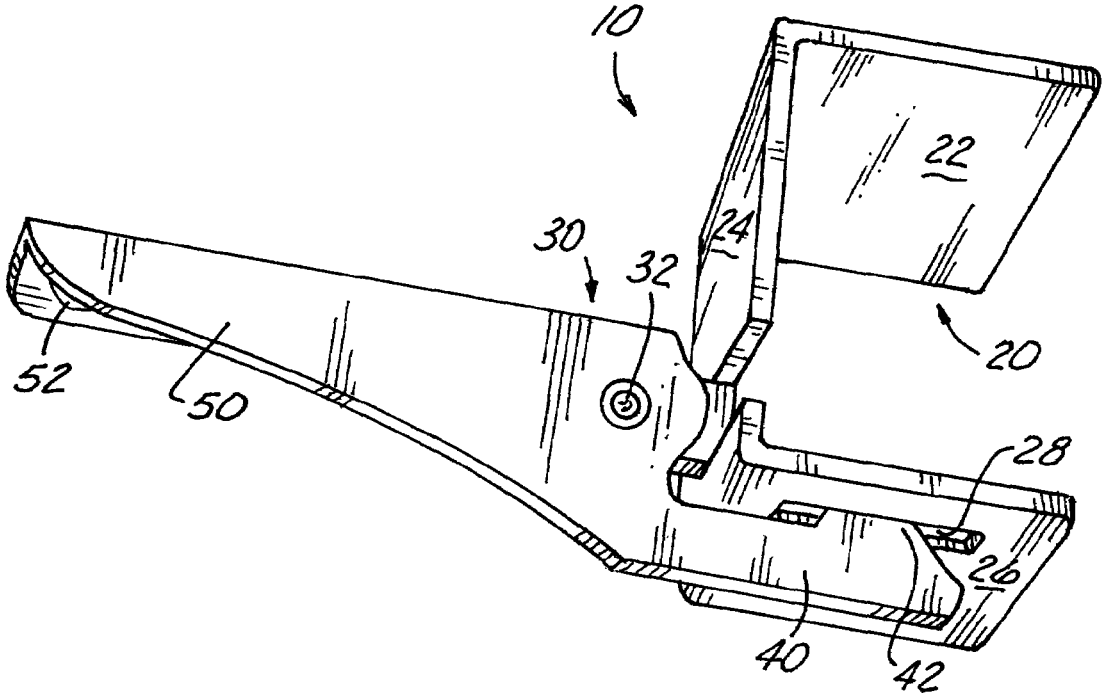
FIG. 7 is a bottom perspective view thereof.

FIGS. 5 and 6 show the lever is pivotally movable between a first position (FIG. 5) where the tooth 42 extends through the opening 28, and a second position (FIG. 6) where the tooth 42 is spaced below the bottom 26 of the bracket 20. When the operator wishes to use the gun 100, the gun 100 is lifted so that the weight is no longer on the outer arm 50 of the lever 30 and the tooth 42 disengages from the framing member 60.

The nail gun hanger 10 is a product designed for use in residential or commercial construction. The hanger 10 allows the operator to conveniently hang the gun 100 on the nearest framing member 60 to enable the use of both hands for other tasks. The weight of the gun 100 on the outer arm 50 of the lever 30 drives the tooth 42 of the inner arm 40 into the bottom surface 66 of the framing member 60 locking the hanger 10 and attached gun 100 in place. When the gun 100 is lifted and the weight is relieved, the gun 100 is easily removed from the framing member 60.

The nail gun hanger 10 of the present invention allows the user to hang the gun 100 in a convenient location while using both hands to manipulate the piece to be nailed. With the nail gun 100 secured in place, the operator is free to move about on a ladder or scaffold while the nail gun 100 is still in convenient position for the next step of the framing job. Also, securing the nail gun 100 in position while not in use eliminates the hazards of accidentally dropping the gun 100 and causing injuries or damage to equipment.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A framing hand tool, comprising:

a C-shaped bracket having a top, a side, and a bottom, the bracket being disposed to engage a corresponding top, side, and bottom surface of a framing member;

a lever pivotally attached at a pivot point to the bracket, the lever having an inner arm including a tooth extending from a first side of the pivot point, and an outer arm having a nail gun attachment point extending from a second side of the pivot point, the lever being pivotally movable between a first position wherein the tooth of the inner arm is disposed to frictionally engage the bottom surface of the framing member, and a second position wherein the tooth of the inner arm is spaced below the bottom surface of the framing member; and a nail gun attached to the outer arm of the lever at the attachment point; and wherein the bottom of the bracket includes an opening disposed in registry with the tooth of the inner arm.

2. The tool of claim 1, wherein the nail gun attachment point includes an opening formed in an end of the outer arm.

3. The tool of claim 2, wherein an air hose fitting is attached to the nail gun adjacent the opening in the end of the outer arm.

4. The tool of claim 1, wherein the nail gun attachment point includes an opening formed in an end of the outer arm.

5. The tool of claim 4, wherein an air hose fitting is attached to the nail gun adjacent the opening in the end of the outer arm.

6. A framing hand tool, comprising:

a bracket having a pair of parallel sections interconnected by an intermediate section, the bracket being disposed to engage three surfaces of a rectangular framing member;

a lever pivotally attached at a pivot point to the bracket, the lever having a first arm including a tooth extending from a first side of the pivot point, and a second arm having a nail gun attachment point extending from a second side of the pivot point, the lever being pivotally movable between a first position wherein the tooth of the first arm is disposed to frictionally engage one of the three surfaces of the framing member, and a second position wherein the tooth of the first arm is spaced away from the one of the three surfaces of the framing member; and a nail gun attached to the outer arm of the lever at the attachment point and wherein the bracket includes an opening disposed in registry with the tooth of the first arm.

7. The tool of claim 6, wherein the nail gun attachment point includes an opening formed in an end of the second arm.

8. The tool of claim 7, wherein an air hose fitting is attached to the nail gun adjacent the opening in the end of the outer arm.

9. The tool of claim 6, wherein the nail gun attachment point includes an opening formed in an end of the second arm.

10. The tool of claim 9, wherein an air hose fitting is attached to the nail gun adjacent the opening in the end of the second arm.

* * * * *